United States Patent [101]

Rotter

[11] 4,052,876

[45] Oct. 11, 1977

[54] BEDPLATES FOR A ROLLING MILL OR THE LIKE

[75] Inventor: Friedrich Rotter, Kreuztal Kredenbach, Germany

[73] Assignee: Schloemann-Siemag Aktiengesellschaft, Germany

[21] Appl. No.: 638,130

[22] Filed: Dec. 5, 1975

[30] Foreign Application Priority Data

Dec. 20, 1974 Germany ..... 2460313

[51] Int. Cl.[2] ..... B21B 31/00

[52] U.S. Cl. ..... 72/237; 248/19; 403/147; 72/455

[58] Field of Search ..... 72/237, 199, 455, 238, 72/456; 248/2, 19, 13, 346; 403/167, 186, 240, 241, 409; 52/759 G, 759 R, 759 D, 126, 127; 46/27-29

[56] References Cited

U.S. PATENT DOCUMENTS

| | | | |
|---|---|---|---|
| 721,047 | 2/1903 | Kennedy | 248/19 X |
| 2,110,990 | 3/1938 | Forbes | 46/28 X |
| 3,585,831 | 6/1971 | Lemper | 72/239 |

*Primary Examiner*—Milton S. Mehr
*Attorney, Agent, or Firm*—Daniel Patch; Suzanne Kikel

[57] ABSTRACT

The disclosure of this invention pertains to a solid construction for a bedplate used in a stand of a rolling mill. The bedplate is characterized by having a uniform cross section throughout its length wherein a groove for supporting a housing is easily formed and adapted to receive a filler element, such as a wedge, for anchoring the housing to the bedplate.

1 Claim, 2 Drawing Figures

BEDPLATES FOR A ROLLING MILL OR THE LIKE

In present day rolling mills and the like, bedplates are used to secure the housings of a roll stand to the foundation for the purpose of transferring from the housing into the bedplate, and hence, into the foundation, the weight of the stand. These bedplates are usually hollow cast pieces produced at relatively high costs due to the fact that these cast pieces are made in intricate molds using patterns, cores, etc., and after casting require machining of the bedplate grooves, as well as the upper and lower surfaces thereof contacting the housing and foundation, respectively.

It is, therefore, an object of this invention to eliminate the use of intricate molds by constructing a solid structure wherein the groove for supporting the housing can be easily formed and machined. This solid structure may be produced either by rolling a steel workpiece, such as a narrow slab or bloom, in which the grooves are burnt out and machined, or casting a solid steel block in which the grooves are preformed and then machined.

It is another object of this invention to provide a bedplate which can be manufactured inexpensively without affecting the stability and operation of the stand itself. For example, it has been found that the cost of manufacturing bedplates can be considerably reduced if the scrap parts of rolled workpieces are used for the bedplates.

In order to make it possible to use the rolled workpiece or the cast steel block as disclosed in this invention, it is another object of the invention to machine, for instance by milling or planing, the bedplate surfaces contacting the housing and/or the foundation. From the above, it can easily be understood that this novel type of bedplate construction requires very little expense since no costly molds are used and the machining for forming the grooves for the housings and wedges does not exceed the machining necessary for finishing a bedplate made by intricate molds.

Figure 1:
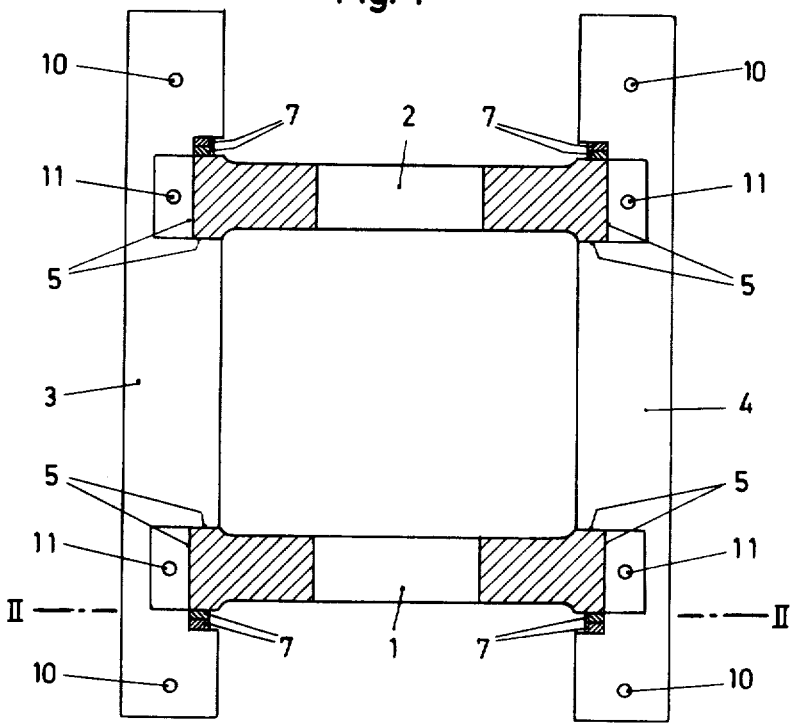
Figure 2:
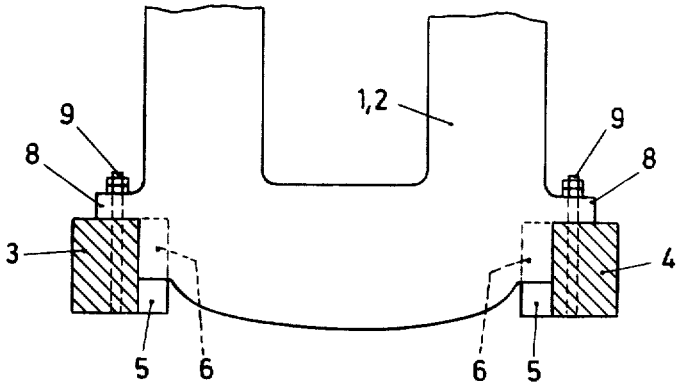

These objects as well as other features and advantages of the present invention will be better understood and appreciated when the following description of one embodiment thereof is read along with the accompanying drawings of which:

FIG. 1 is a plan view, partly in section, of a roll stand incorporating bedplates built in accordance with the present invention, and FIG. 2 is a sectional view, taken along lines II—II of FIG. 1 with the top of the housing broken away.

In referring to the drawings, there is illustrated, as one views FIG. 1, housings 1 and 2 supported on two rectangular shaped bedplates 3 and 4. Each bedplate 3 and 4, as mentioned, can either be a steel rolled workpiece from a waste product or a block cast of steel. In either instance, the bedplates 3 and 4 are of a construction having a uniform cross section throughout its length. Each bedplate 3 and 4 has a pair of grooves 5 in which, as shown in FIG. 1, the groove of one bedplate is arranged opposite the groove of the other bedplate, in a manner to receive the housings 1 and 2. The roll housings 1 and 2, as shown in FIG. 2, are provided with ears 6 located at the base of the housings. Wedges 7, only shown in FIG. 1, are inserted between the grooves 5 and ears 6 in order to stabilize the housings 1 and 2, which are mounted to the bedplates 3 and 4 by projections 8 and secured by bolts 9 (only shown in FIG. 2).

If rolled steel workpieces are used to produce bedplates 3 and 4, the grooves 5 may be formed by flame cutting and finished by machining. If, on the other hand, the bedplates are made of cast steel blocks, the grooves which are formed by the casting mold, need only to be machined. The surfaces of the bedplates contacting the foundation, as well as the surfaces contacting the projections 8 of the roll housings 1 and 2, can then be finished by milling or planing.

Again, in referring to FIG. 1, holes 10 receive bolts (not shown) that secure bedplates 3 and 4 to the foundation and holes 11 receive bolts 9 that anchor housings 1 and 2 to the bedplates 3 and 4. These holes 10 and 11 are made by employing core pins in the molds before casting or by boring after the workpiece is rolled. In any event, bedplates 3 and 4 are produced at relatively low costs, and therefore, reduce considerably the construction costs of roll stands.

It should be noted, however, that although the bedplates illustrated herein are used in a single roll stand, the invention also provides for constructing the bedplates long enough to support and stabilize housings of two or more stands in a tandem rolling mill.

In accordance with the provisions of the patent statutes, I have explained the principle and operation of my invention and have illustrated and described what I consider to represent the best embodiment thereof.

I claim:

1. A rolling mill or the like comprising:

a pair of vertically arranged spaced apart housings one behind the other, each having a window extending through the housings from its front side to its back side for receiving rolls of the mill, horizontal extending feet formed on the opposite outer sides of the lower portion of each said housing, and having straight supportable horizontal surfaces, a vertical projection extending perpendicularly downwardly from each said feet and each having three vertical engageable surfaces, a pair of elongated bedplates, one bedplate engaging said supportable horizontal surfaces of said housings on similar opposite side thereof, and the other bedplate engaging said supportable horizontal surfaces of said housings on said other similar opposite side thereof, said bedplates being formed of an as cast or as a hot rolled product having a rectangular cross section shape throughout their lengths, a vertical groove for each vertical projection formed in each of said bedplates, said groove each having three straight vertical engageable surfaces, two of which are constructed and arranged to engage two corresponding surfaces of an associated said vertical projection, each said grooves being made so that one of its straight engageable surfaces provide a space between a said remaining surface of said straight engageable surface of a said vertical projection of said housings, filler means, of wedge like configuration for each groove, each filler means having opposed straight engageable surfaces, each said filler means locatable in a groove between one of said straight vertical surfaces thereof and said remaining straight engaging surface of a vertical projection of a housing for stabilizing said housings, each bedplate having a surface for supporting said supportable horizontal surfaces of an associated horizontal foot of said housings and thereby carrying the weight of said housings, and means for securing each of said feet to said associated bedplate.

* * * * *